US012798034B2

(12) United States Patent
Leonhardt et al.

(10) Patent No.: US 12,798,034 B2
(45) Date of Patent: Nov. 17, 2026

(54) METHOD AND DEVICE FOR FINELY MACHINING AXICONS, FINE MACHINING DEVICE SUITABLE FOR THIS PURPOSE, AND USE THEREOF

(71) Applicant: Satisloh GmbH, Wetzlar (DE)

(72) Inventors: Christian Leonhardt, Wehrheim (DE); Eva Silbach, Lahnau (DE)

(73) Assignee: Satisloh GmbH, Wetzler (DE)

( * ) Notice: Subject to any disclaimer, the term of this patent is extended or adjusted under 35 U.S.C. 154(b) by 699 days.

(21) Appl. No.: 18/269,862

(22) PCT Filed: Dec. 16, 2021

(86) PCT No.: PCT/EP2021/086335
§ 371 (c)(1),
(2) Date: Jun. 27, 2023

(87) PCT Pub. No.: WO2022/144189
PCT Pub. Date: Jul. 7, 2022

(65) Prior Publication Data

US 2024/0058919 A1 Feb. 22, 2024

(30) Foreign Application Priority Data

Dec. 30, 2020 (DE) ..... 10 2020 007 920.2

(51) Int. Cl.
*B24B 13/04* (2006.01)
*B24B 13/06* (2006.01)
*B24B 41/04* (2006.01)

(52) U.S. Cl.
CPC ..... *B24B 13/046* (2013.01); *B24B 13/06* (2013.01); *B24B 41/04* (2013.01)

(58) Field of Classification Search
CPC ..... B24B 13/06; B24B 13/046; B24B 41/02; B24B 41/04; B24B 47/04; B24B 9/14; B24B 9/148
(Continued)

(56) References Cited

U.S. PATENT DOCUMENTS 4,802,309 A 2/1989 Heynacher
4,850,152 A 7/1989 Heynacher et al.
(Continued)

FOREIGN PATENT DOCUMENTS

DE 19543184 A1 3/1997
DE 19616526 A1 * 11/1997 ..... B23Q 1/623
(Continued)

OTHER PUBLICATIONS

DE-19616526-A1 English Translation (Year: 1997).*
(Continued)

*Primary Examiner* — Makena S Markman
(74) *Attorney, Agent, or Firm* — Reising Ethington P.C.

(57) ABSTRACT

In a method for fine-processing of an axicon (L) having a concave or convex cone surface (KF) with a cone axis (KA) and a cone angle (α), with use of geometrically indeterminate cutting edges in the form of grain in combination with a liquid at a processing region (BB) of a tool (W2), which is constructed for linear engagement (LE) with the cone surface and has a front end (EB) with respect to the cone axis, material removal is produced at the cone surface by a relative cutting speed which results from a rotational movement of the axicon about the cone axis and a relative oscillating linear movement (oscillation axis R) of the tool, in which the processing region is disposed in linear engagement with the cone surface and its front end moves back and forth in a direction radial with respect to the cone axis.

10 Claims, 10 Drawing Sheets

(58) Field of Classification Search
USPC ..... 451/42, 325, 163, 162, 173, 166
See application file for complete search history.

(56) References Cited

U.S. PATENT DOCUMENTS

| | | | | |
|---|---|---|---|---|
| 4,989,316 | A * | 2/1991 | Logan | B23Q 1/4857 29/527.3 |
| 6,122,999 | A * | 9/2000 | Durazo | C07K 14/47 82/134 |
| 6,394,892 | B2 | 5/2002 | Hanisch et al. | |
| 8,696,410 | B2 | 4/2014 | Schussler et al. | |
| 9,278,418 | B2 * | 3/2016 | Schmidt | B24B 13/046 |
| 9,321,145 | B2 | 4/2016 | Wallendorf et al. | |
| 9,625,623 | B2 | 4/2017 | Kiontke et al. | |
| 10,493,534 | B2 | 12/2019 | Klose | |
| 10,583,540 | B2 | 3/2020 | Wallendorf et al. | |
| 11,583,971 | B2 | 2/2023 | Diehl et al. | |
| 2007/0180961 | A1 * | 8/2007 | Imai | B23B 29/125 82/1.5 |
| 2011/0065361 | A1 | 3/2011 | Schussler et al. | |
| 2013/0272653 | A1 | 10/2013 | Le et al. | |
| 2015/0128773 | A1 * | 5/2015 | Schneider | B24B 41/02 82/123 |
| 2017/0246720 | A1 | 8/2017 | Wallendorf et al. | |
| 2019/0184515 | A1 | 6/2019 | Diehl et al. | |

FOREIGN PATENT DOCUMENTS

| | | | |
|---|---|---|---|
| DE | 102014015053 | A1 | 4/2016 |
| DE | 102016006791 | A1 | 12/2017 |
| EP | 2298498 | A2 | 3/2011 |

OTHER PUBLICATIONS

EPO as ISA—International Search Report, Int. Application No. PCT/EP2021/086335, Int. Filing Date: Dec. 16, 2021, Applicant: Satisloh GmbH, Date: May 4, 2022.

German 1st Office Action, Application No. 10 2020 007 920.2, Applicant: Satisloh GmbH, Dated; Oct. 26, 2021.

English Translation of the International Preliminary Report on Patentability, Int. Application No. PCT/EP2021/086335, Int. Filing Date: Dec. 16, 2021, Applicant: Satisloh GmbH, Mail Date: Jul. 13, 2023.

Chinese First Office Action, Application No. 202180050974.9, Applicant: Satisloh Gmbh, Title: Method and Device for Finely Machining Axicons, Fine Machining Device Suitable for this Purpose, and Use Thereof, Dated: Jan. 28, 2026.

* cited by examiner

METHOD AND DEVICE FOR FINELY MACHINING AXICONS, FINE MACHINING DEVICE SUITABLE FOR THIS PURPOSE, AND USE THEREOF

TECHNICAL FIELD

The present invention relates generally to a method and a device for fine-processing of an axicon as well as to a fine-processing machine, which comprises such a device, and the use of this fine-processing machine for the fine-processing of an axicon. In particular, the invention relates to a method and a device for grinding, precision-grinding and/or polishing of convexly or concavely conical lens surfaces such as may undergo bulk processing in precision optics.

An "axicon" in customary technical use of language is a special lens which is formed to be conical or cone-shaped at at least one of its two optically effective surfaces. Axicons can be convex or concave and are produced from any optical material such as quartz glass, silicon dioxide, germanium, silicon, infrared glass (chalcogenide glass), Zerodur (Registered Trade Mark), etc. Approximately planoconvex or planoconcave axicons are typical. In the terminology of the present invention there is to be understood by "axicon" in the most general sense any workpiece, regardless of material, which has—at at least one workpiece surface—at least one section formed to be convexly or concavely conical. Even when in connection with the present invention there is mention in the following of a "cone surface" this expression is to be understood in the widest sense and to also include—in addition to conical annular surfaces with any axial boundary—non-annular, convexly or concavely curved surface sections, which satisfy the mathematical description of a right circular cone, of a workpiece with any boundary all round.

PRIOR ART

Individual axicons produce, for example from a laser beam, an annular beam profile. The diameter of the annular beam is in that case dependent on the cone angle of the axicon and increases with increasing spacing between axicon and image plane, in which case the ring width remains constant. Through the combination of an axicon with further axicons or other lenses it is possible to produce multiple beam profiles such as described in, for example, document U.S. Pat. No. 9,625,623 B2.

Axicons thus principally find use in beam shaping and in diverse laser applications in the high-power field. For example, axicons are used in the medical field in laser eye surgery. The capability of focusing a laser beam in an annular beam profile is helpful here for smoothing and removal of corneal tissue. In that case, the diameter of the ring for an optimal power distribution can be set by the combination of a convex and a concave axicon as well as variation of the mutual spacing.

With regard to the technical demands placed on axicons it is to be mentioned at this point that in the above-mentioned applications the permissible surface shape differences (RMSi=root-mean-square difference according to DIN ISO 10110) lie in a range of RMSi≤0.7 μm, in part even RMSi≤0.04 μm, depending on the use. The RMSi value in that regard describes the difference between the total form error and the best-adapted spherical surface. Accordingly, there are comparatively high demands on the processing quality to be achieved for the fine-processing of axicons.

The production or processing of optically effective surfaces of axicons can be roughly divided into two processing phases, i.e. firstly shaping or preliminary processing of the optically effective surfaces for producing the desired macrogeometry and then fine-processing of the optically effective surfaces in order to eliminate preliminary processing tracks and obtain the desired microgeometry. Whereas the shaping or preliminary processing of the optically effective surfaces of axicons is carried out, inter alia, in dependence on the material of the axicon by milling, turning and/or grinding or, however, also original shaping or reshaping (see, for example, document U.S. Pat. No. 9,821,522 B2), the optically effective surfaces of axicons in fine-processing are usually subjected to a precision-grinding, lapping and/or polishing process in which geometrically indeterminate cutting edges in the form of bound or loose grain in combination with a liquid between workpiece and tool, which in that case are moved relative to one another, is employed.

In a known method for processing an axicon—similar to the process disclosed in document DE 195 43 184 A1—the conical surfaces of the axicon are processed to finished state by a diametrally smaller polishing tool with a conical circumferential surface. In that case, the polishing tool drivable to rotate about its center axis is so positioned with respect to the axicon similarly drivable to rotate about its cone axis that the center axis of the polishing tool and the cone axis of the axicon lie in a plane, wherein the circumferential surface of the polishing tool is aligned with the conical surface, which is to be polished, of the axicon. As a result, the circumferential surface of the polishing tool and the conical surface, which is to be polished, of the axicon are in engagement along a circumferential surface section of the polishing tool. During polishing, which takes place under the feed of a liquid polishing medium, the polishing tool and the axicon are driven to rotate in the same sense or (preferably) in opposite sense, wherein the polishing tool is additionally moved axially along its circumferential surface section, which is in contact with the conical surface of the axicon to be polished, until the conical surface of the axicon is fully polished.

By virtue of the superimposition of the two rotational movements of the polishing tool and the axicon a comparatively large polishing removal can be achieved particularly in the case of rotational drive in opposite sense. However, the relative movement between polishing tool and axicon generated in that case runs almost exclusively in circumferential direction or, depending on the advance of the polishing tool along the contacting circumferential surface section of the polishing tool, even slightly spirally. Moreover, different removal effects are achieved in different polishing regions depending on radial spacing from the center or cone axis. In this known polishing process there is the risk that as a consequence of the afore-described engagement relationships between tool and workpiece there is formation of structures with a radial predominant direction on the polished surface and this should be avoided particularly in view of the above-described background of the desired processing or surface qualities.

Finally, the document U.S. Pat. No. 4,850,152 discloses a method and a device for lapping or polishing very large optical components such as, for example, for astronomical observations. The main mirror of a telescope is given here as a concrete example. In this state of the art the tool is formed as a strip-shaped flexible membrane of, in the disclosed example, 5 meters length and 1 meter width, which covers only a part region of the surface to be processed of the workpiece. Provided on the side of the membrane remote from the surface to be processed is a plurality of loading elements which are supported by individually controllable force on the rear side of the membrane and urge this with a defined pressure distribution areally against the surface to be processed. In addition, the prior art device has for the workpiece a rotary drive with an angle encoder connected therewith, the output of which is connected with a control serving the purpose of activating the loading elements.

During the actual processing the membrane is set into an oscillating movement in radial direction by way of the surface, which rotates thereunder and is to be processed, of the workpiece, wherein the loading elements urging the membrane against the surface to be processed are stationary relative to the workpiece and do not participate in the oscillatory movement of the membrane. In that case, the time plot of the pressure distribution is controlled in dependence on the rotational angle between workpiece and tool, particularly to shorten the processing time. However, a fine-processing of axicon is neither addressed in this prior art nor is it even possible with the pressure distribution concept disclosed therein, in view of the cone geometry, which is to be fine-processed, at the axicon, the usual dimensions thereof and the processing accuracy to be achieved here.

What is desired is to provide a simplest possible method for fine-processing of an axicon, which addresses the problem discussed above with respect to the prior art. In particular, the method shall enable a fastest possible fine-processing of an axicon with high processing quality and without the risk of formation of undesired structures or other surface faults on the fine-processed cone surface of the axicon. What is further desired is an indication of a device for improved fine-processing of an axicon, which is usable as simply as possible and without substantial outlay on preparation, as well as a fine-processing machine suitable for that purpose, including use thereof for high-quality fine-processing of an axicon.

SUMMARY OF THE INVENTION

According to one aspect of the invention, in a method for fine-processing of an axicon having at least one concave or convex cone surface with a cone axis and a cone angle, it is provided to produce—by use of a tool which has a processing region for linear engagement with the cone surface to be processed, which region has a front end with respect to the cone axis, with use of geometrically indeterminate cutting edges in the form of bound or loose grain in combination with a liquid at the processing region of the tool—a material removal at the cone surface of the axicon by a relative cutting speed which results solely from a rotational movement of the axicon about the cone axis and a relative oscillating linear movement along an oscillation axis of the tool that in this case is disposed in linear engagement with the cone surface to be processed, in which the front end of the processing region as seen in a plan view moves back and forth in radial direction with respect to the cone axis.

As investigations by the inventors have shown, radial groove structures, surface shape faults, high levels of surface roughness and angle errors on or at the cone surface of the axicon are reliably avoided by the tool which oscillates in cone angle direction merely transversely to the rotational movement of the axicon and which bears only linearly against the cone surface of the axicon to be processed. As a consequence of the method according to the invention, the processed cone surface of the axicon is much more cleanly smoothed. Comparatively high removal performance and thus a fastest possible fine-processing can be readily achieved by suitable selection of the rotational speed of the axicon about the cone axis and/or the oscillation frequency of the tool over the cone surface to be processed of the axicon. In the linear contact, which is provided in accordance with one aspect of the invention, of the tool with the cone surface of the axicon it is in addition advantageously possible to impart to the tool a specific degree of biasing by appropriate adjustment of the tool relative to the cone surface at its front or rear end with respect to the cone axis and to thus influence the pressure distribution over the length of the tool, whereby an angle correction at the cone surface of the axicon is also possible within limits.

In that regard, it is possible to provide in an expedient method embodiment a two-stage procedure in which initially a relative alignment and adjustment movement (1st stage) is produced between the axicon and the tool in accordance with the cone angle, as a consequence of which the processing region of the tool enters into the linear engagement with the cone surface of the axicon, wherein the front end of the processing region faces the cone axis, whereupon there is produced between the axicon, which is driven to rotate about the cone axis or about a workpiece axis of rotation, and the tool the relative oscillating linear movement along the oscillation axis as an advance movement (2nd stage) in which the front end of the processing region during a revolution of the axicon about the cone axis moves as seen in plan view multiple times over the cone surface from an outer edge region of the cone surface in a direction, which is radial with respect to the cone axis, to at least the proximity of the cone axis and back again.

In this connection, "to at least the proximity of the cone axis" means that in the case of the advance movement, more precisely with a suitable oscillation stroke of the advance movement, it is ensured that the entire cone surface of the axicon is covered by the tool and thus subjected to fine-processing. In the case of a convex cone surface this can comprise an advance movement of the tool out beyond the cone axis. In the case of the cone surface of a concave axicon, which as a consequence of its preliminary processing for producing the desired macrogeometry usually has in the region of the cone axis a transition, which extends along the cone axis, with a small diameter of, for example, 2 millimeters, the advance movement in the direction of the cone axis ends when the tool reaches this transition by the front end of its processing region. In other words, it is ensured in the case of a concave cone surface that the tool during its advance movement does not oscillate out beyond the cone axis by the front end of its processing region.

In further pursuance of the concept of the invention it can be provided that during the fine-processing of the cone surface a rotational speed of the axicon about the cone axis and a frequency of the relative oscillating linear movement along the oscillation axis of the tool over the cone surface can be so matched to one another that the number of reciprocating movements of the tool per revolution of the axicon is not an even number. It is thereby avoided in simple manner that the tool after a revolution of the axicon about the cone axis is disposed in almost exactly the radial position in which it found itself at the start of this revolution of the axicon. Thus, a continuous "track change" of the tool on the finely-processed cone surface advantageously takes place with each revolution of the axicon about the cone axis during the fine processing. This is conducive to a very good surface quality. In this regard, as far as the number of reciprocating movements of the tool per revolution of the axicon is concerned this can in principle be an integral number or, however, also a non-integral number so that the reversal points of the tool lie at different angle positions of the axicon with respect to the cone axis.

As investigations of the inventors have shown, it is advantageous if during the fine-processing of the cone surface the number of reciprocating movements of the tool per revolution of the axicon about the cone axis is greater than or equal to three and smaller than or equal to seven. In the case of a corresponding relationship of frequency to rotational speed, the dwell times of the processing region of the tool on a surface section of the cone surface of the axicon are not too long and also not too short, so that a very good, i.e. uniform, fine-processing result can be achieved.

According to a further aspect of the invention a device for fine-processing of an axicon having at least one concave or convex cone surface with a cone axis and a cone angle comprises a tool which has a processing region for linear engagement with the cone surface to be processed, wherein the device has a base which is adapted to be flange-mounted on a tool spindle of a fine-processing machine and on which is mounted a guide arrangement guiding a tool carriage, which is drivable for oscillation along an oscillation axis and carries the tool for fine-processing of the axicon, to be longitudinally movable.

Thus, for the fine-processing of an axicon, which can take place as described in the foregoing, it is not necessary to make available a fine-processing machine specially constructed for that purpose, but rather use can be made of a conventional grinding or polishing machine, on the spindle of which the device according to the invention for fine-processing of an axicon is mounted by its base. Rapid equipping of an existing grinding and polishing machine for the fine-processing of axicons is thus possible without substantial outlay on preparation. For the actual fine-processing, the existing machine axes of the grinding or polishing machine are then advantageously employed in order to effect adjustment and alignment of the tool by its processing region with respect to the cone surface to be processed at the axicon.

In addition, the present invention also provides a fine-processing machine comprising a tool spindle with a tool axis C of rotation and a workpiece spindle with a workpiece axis D of rotation, which project into a work space bounded by a machine bed and which are movable relative to one another (Y axis, Z axis) at least in a notional plane Y-Z spanned by the tool axis of rotation and the workpiece axis of rotation as well as displaceable relative to one another with respect to a pivot axis A extending perpendicularly to the plane Y-Z, wherein the device proposed herein for fine-processing of an axicon is mounted on an end, which faces the workpiece spindle, of the tool spindle.

The machine bed of the fine-processing machine can in that case have, in an embodiment which is particularly stiff and created specifically for high accuracy requirements in optics manufacture, two side walls between which the work space is formed and which mount a portal, which is movable in a longitudinal direction along the Y axis and at which the tool spindle is guided to be movable along the Z axis at least in a direction perpendicular to the longitudinal direction along the Y axis, and wherein provided in the work space is a yoke which carries the workpiece spindle and which is mounted at the side walls to be rotatable about the pivot axis A, such as is described in, for example, German Patent DE 100 29 967 B4 of the present applicant.

Moreover, the present invention provides a use of the afore-described fine-processing machine, on the tool spindle of which the proposed device for fine-processing of an axicon is mounted, for the fine-processing of an axicon having at least one concave or convex cone surface with a cone axis and a cone angle.

With further regard to the device for fine-processing of an axicon, the guide arrangement thereof can have, in an embodiment of particularly simple construction, a guide frame on which guide rails for the tool carriage are mounted on mutually opposite sides.

In principle, the guide rails can in that case be such with roller bodies which are particularly easy-running. On the other hand, however, and also with respect to low costs and a simple configuration of the device it is preferred if the guide rails, which are made out of a slide bearing material such as, for example, a sintered bronze, a copper alloy, a suitable plastics material such as, for example, polytetrafluorethylene (PTFE) or Teflon (Registered Trade Mark) or the like, have a V-shaped groove on each of mutually facing sides, wherein the tool carriage on each of mutually remote sides has a wedge-shaped guide section, and wherein the wedge-shaped guide sections of the tool carriage are received in the V-shaped grooves of the guide rails to be capable of sliding. In such an embodiment the guide arrangement is particularly insensitive to the abrasive polishing material, thus low in wear, is simple to clean and moreover for sufficient easy-running does not require additional lubrication by greases or the like, which could be detrimental to a good polishing result.

In principle it is possible for the device for fine-processing of axicons to have an individual linear drive by which the tool carriage can be driven to oscillate so as to reciprocatingly move the tool by its processing region over the cone surface to be fine-processed. In that regard, it can be, for example, a moving-magnet linear motor, the permanent magnets of which are secured to the tool carriage serving as rotor, while its coil stack is mounted as stator on the base of the device.

On the other hand, however, it is particularly preferred with respect to technological outlay—which as far as possible is low—and a simple possibility of re-equipping an existing fine-processing machine with the afore-described device for fine-processing of an axicon if a transmission mechanism adapted to convert a rotational movement, which is produced by the tool spindle of the fine-processing machine, into a reciprocating linear movement of the tool carriage along the oscillation axis is provided for the oscillating drive of the tool carriage.

In an embodiment of particular simple construction the transmission mechanism can in that regard comprise a rotary disc which is drivably connectable with the tool spindle of the fine-processing machine and is rotatable about an axis of rotation and on which a guide pin is mounted to be radially offset with respect to the axis of rotation, the pin engaging in a slot which is formed to extend in the tool carriage transversely to the oscillation axis so that the tool carriage is drivable in oscillation along the oscillation axis with a predetermined stroke.

In principle the rotary disc of the transmission mechanism can be provided with only one eccentrically arranged securing bore for the guide pin so as to provide an eccentric drive with only a predetermined, fixed stroke. However, with respect to the most variable possible use of the device for fine-processing of axicons it is preferred if the rotary disc is provided with a plurality of securing bores for the guide pin, the bores having a different radial spacing from the axis of rotation so that the stroke of the tool carriage is settable in steps.

Thus, as far as the tool carriage is concerned, this can in principle be provided with only one slot for the engagement with the guide pin. However, in a preferred embodiment of the tool carriage this has at least two mutually parallelly extending slots for selectable engagement of the guide pin, by way of which an axial relative position of the tool carriage with respect to the axis of rotation is settable. During the fine-processing of a specific axicon, the guide pin then remains in the slot, which was assigned to the pin prior to the fine-processing of this axicon, of the tool carriage. This embodiment is also conducive to the most flexible possible use of the device for the fine-processing of geometrically diverse axicons.

In a particularly simple variant of the device for fine-processing of an axicon the tool can be rigidly connected with the tool carriage optionally with the assistance of a spacer. A specific fine sensitivity during bringing and maintenance of the processing region of the tool into and in engagement with the cone surface, which is to be finely processed, of the axicon must in such a case be performed by way of the movement axes of the fine-processing machine, which requires a suitable sensor system of the fine-processing machine.

However, by comparison therewith an embodiment of the device is preferred in which a connecting part with a further guide arrangement is mounted at the tool carriage, the further guide arrangement serving the purpose of guiding the tool to be movable in a direction transverse to the oscillation axis of the tool carriage, wherein the tool is loaded in the direction transverse to the oscillation axis of the tool carriage by a force which urges the tool away from the connecting part. The device thus itself does not have a "hard" guidance, but advantageously a certain degree of softness so that the tool during fine-processing of the cone surface can deviate against the loading force in the direction transverse to the oscillation axis, which permits particularly gentle fine-processing with respect to the macrogeometry of the cone surface.

In principle, the afore-described force in the direction transverse to the oscillation axis can be generated by, for example, a spring or several springs or with use of an elastomer or a resilient foam or the like, which acts in a pressing or drawing manner between the connecting part and the tool. With respect to, in particular, low wear and a satisfactory possibility of cleaning, in a preferred embodiment of the device for the fine-processing of an axicon the afore-described force is applied by at least two mutually repelling magnets arranged between the connecting part and the tool. Such magnets in this position are in fact exposed to abrasive polishing medium, but are not attacked by this.

For the movable guidance of the tool transversely to the oscillation axis the further guide arrangement can in principle comprise any desired linear guide, for example a linear guide with a profiled guide rail, at the connecting part and a roller-mounted carriage, which runs thereon, on the tool side. With respect to, in particular, a smallest possible need for space it is, however, preferred if the further guide arrangement comprises at least one guide cylinder. Thus, for example, two parallel cylinder bores can be formed in the connecting part and each accept a guide rod suitably secured to the tool.

As seen along the oscillation axis of the tool the connecting part can in principle be mounted on the tool carriage in a fixed axial position and the tool can also be arranged in a fixed axial position relative to the connecting part. On the other hand, however, an embodiment of the device is preferred in which the connecting part is secured to the tool carriage to be variable in its axial position along the oscillation axis and/or the tool is mounted on the further guide arrangement to be variable in its axial position along the oscillation axis. There are thus further possibilities of influencing the axial position of the tool during the fine-processing of an axicon, which in turn is advantageous particularly with respect to most flexible possible use of the device for fine-processing of geometrically diverse axicons.

Different embodiments for the tool itself are conceivable in which the processing region of the tool ensures linear engagement with the cone surface to be processed of the axicon. Thus, the tool in a first variant can, as seen in plan view, have substantially the shape of an isosceles triangle with a processing region which has a front end at an apex of the triangle and permits on each of mutually remote longitudinal sides of the triangle a linear engagement with the cone surface to be processed of the axicon. Such a tool is intended for the processing of concave axicons. Due to the double linear engagement, which takes place at both longitudinal sides of the tool, with the cone surface to be processed of the concave axicon this tool advantageously offers a high level of removal performance.

In a second, alternative variant the tool can be substantially strip-shaped with a processing region which has a front end at a transverse side of the tool and which allows for a linear engagement with the cone surface to be processed of the axicon along a longitudinal side of the tool. Such a tool is equally suitable for processing of concave and convex axicons, but has a lower level of removal performance than the tool according to the above first variant.

With respect to the processing region of the respective tool it is finally to be mentioned at this point that the respective tool is provided thereat with a suitable commercially available polishing medium carrier—such as, for example, a polishing felt or a polishing film—glued to the tool. This polishing medium carrier is not itself specially mentioned or shown in the following.

Further features, characteristics and advantages of the method according to the invention, the device according to the invention as well as the fine-processing machine equipped in accordance with the invention and the use thereof are evident to the expert from the following description of preferred embodiments.

BRIEF DESCRIPTION OF THE DRAWINGS

The invention is explained in more detail in the following on the basis of preferred embodiments with reference to the accompanying partly schematic drawings, in which the same or corresponding parts or sections are provided with the same reference signs and in which:

With regard to the drawings it may be additionally mentioned at this point that the illustration of the fine-processing machine equipped in accordance with the invention is in a right-angled cartesian co-ordinate system in which the letter x denotes the width direction, the letter y denotes the length direction and the letter z denotes the height direction of the fine-processing machine. In FIGS. 1 and 2 in order to expose a view of essential components or subassemblies of the fine-processing machine and to simplify the illustration, the control unit and control, cladding parts, door mechanisms and panels, deposits for workpieces and tools, the supply devices (inclusive of lines, hoses and pipes) for current, compressed air and polishing medium, the polishing medium return as well as the machine-internal measurement, maintenance and safety devices, in particular, were omitted because they do not appear necessary for an understanding of the invention and are in any case familiar to the expert.

DETAILED DESCRIPTION OF THE EMBODIMENTS

Figure 1:
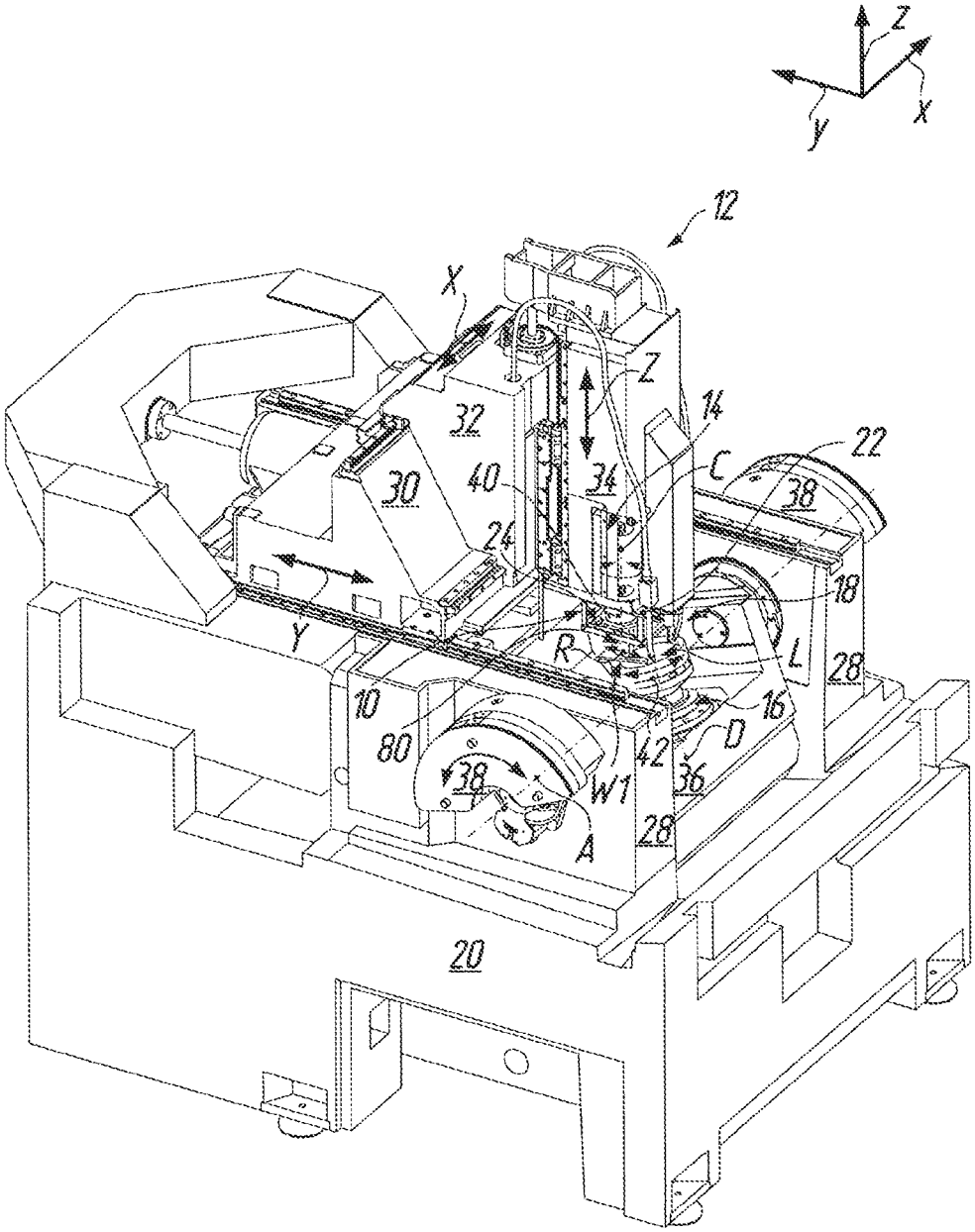
FIG. 1 shows a perspective view of a fine-processing machine, which is equipped in accordance with the invention, for optical workpieces obliquely from above and the front left, with a view into a work space of the fine-processing machine and onto a device according to the invention for fine-processing of an axicon, the axicon being mounted thereat on an end of a tool spindle which is upper in FIG. 1 and which faces a workpiece spindle, which is lower in FIG. 1, in a pivotable yoke of the fine-processing machine.
Figure 2:
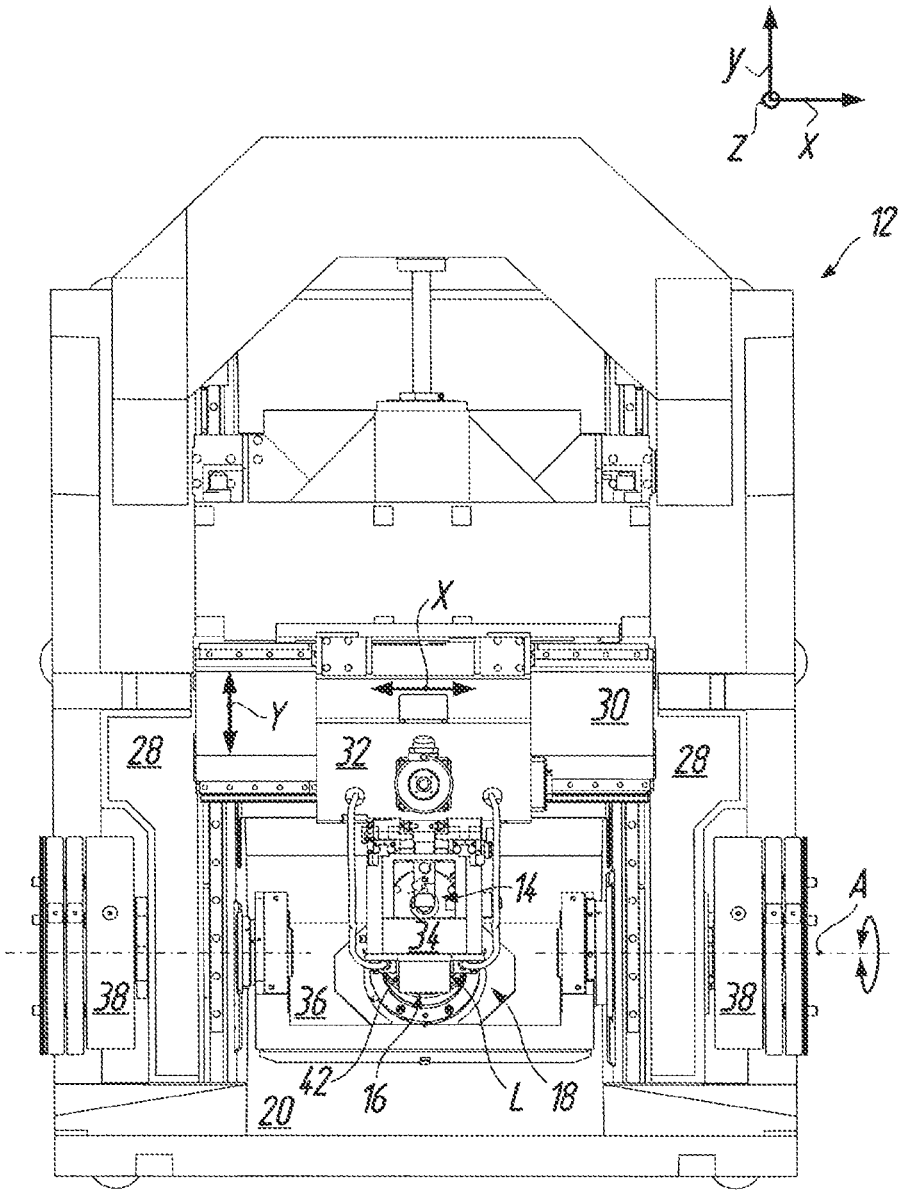
FIG. 2 shows a plan view of the fine-processing machine, which is shown in FIG. 1, from above in FIG. 1.
Figure 3:
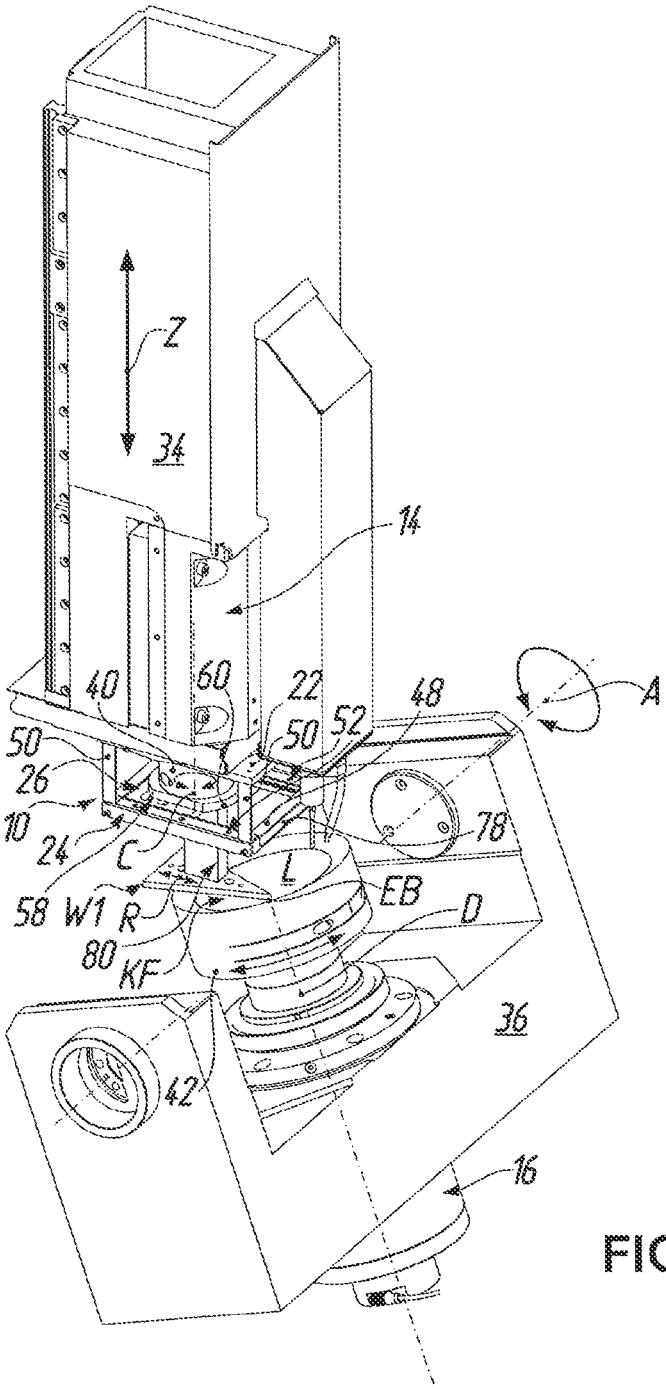
FIG. 3 shows a perspective view, which is increased in size relative to the scale of FIGS. 1 and 2, of separately depicted subassemblies of the fine-processing machine according to FIG. 1 obliquely from above and the front left, namely of a vertical carriage with the tool spindle and of the yoke with the workpiece spindle as well as the device, which is arranged therebetween, for fine-processing of an axicon, wherein a substantially triangular tool, which is driven to linearly oscillate, of the device is disposed in processing engagement with a rotationally driven concave axicon mounted on the workpiece spindle.
Figure 4:
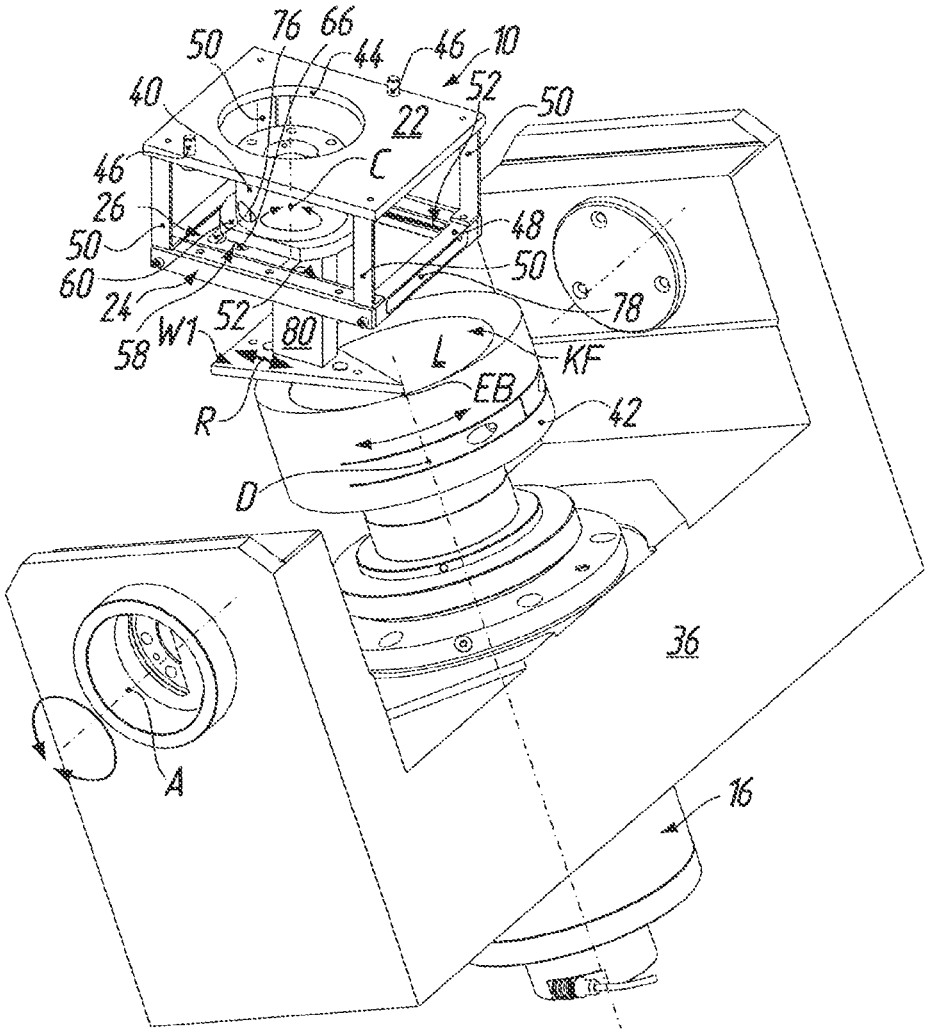
FIG. 4 shows a perspective view of separately depicted subassemblies of the fine-processing machine according to FIG. 1 obliquely from above and the front left, which perspective view is again increased in size relative to the scale of FIG. 3 and differs from the view according to FIG. 3 merely in that the vertical carriage with the tool spindle was omitted—apart from the clamping chuck thereof—so as to expose a view of the device for fine-processing of an axicon.
Figure 5:
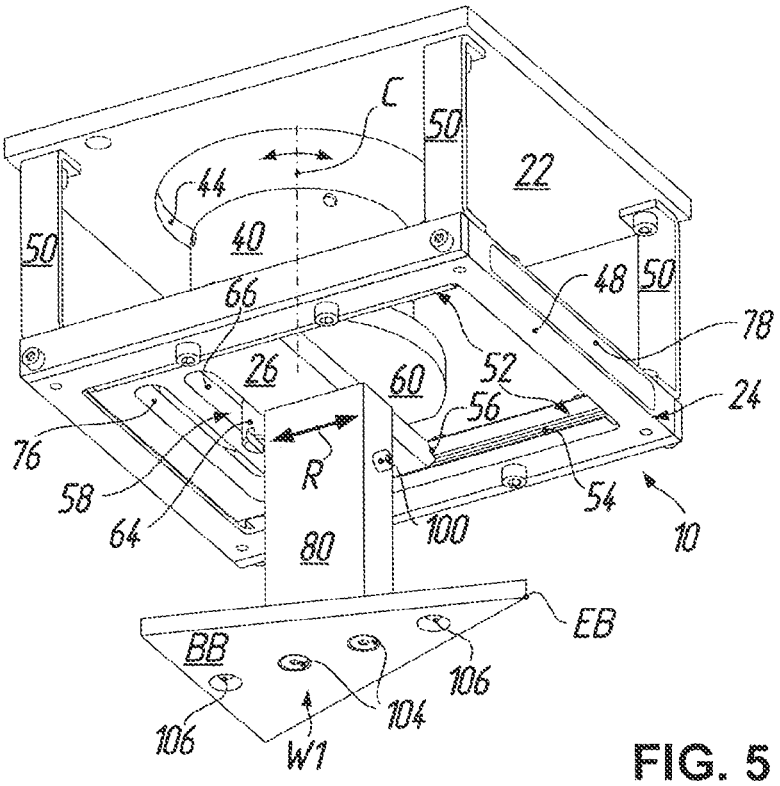
FIG. 5 shows a perspective view, which is again increased in size relative to the scale of FIG. 4, of the device for fine-processing of an axicon according to FIG. 1 obliquely from below and the front left, which device—apart from the clamping chuck of the tool spindle—is shown separately from the fine-processing machine according to FIG. 1.
Figure 6:
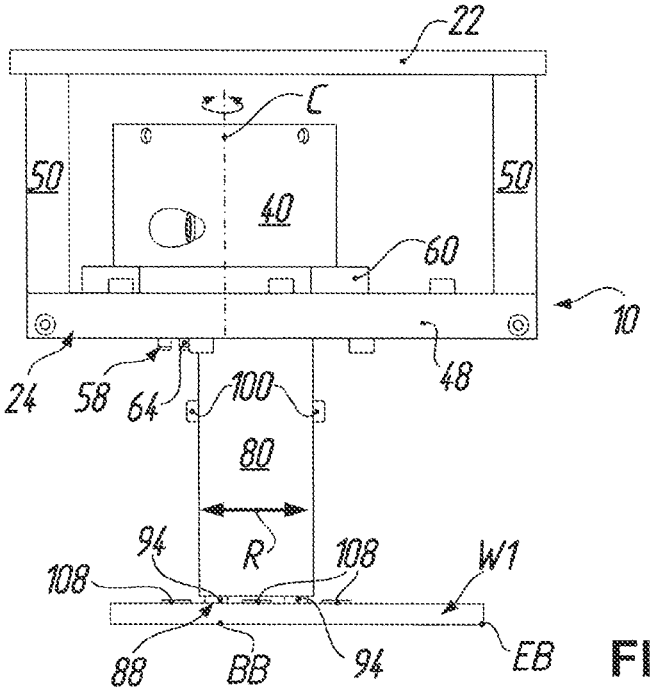
FIG. 6 shows a side view of the device, which is shown in FIG. 5, for fine-processing of an axicon.
Figure 7:
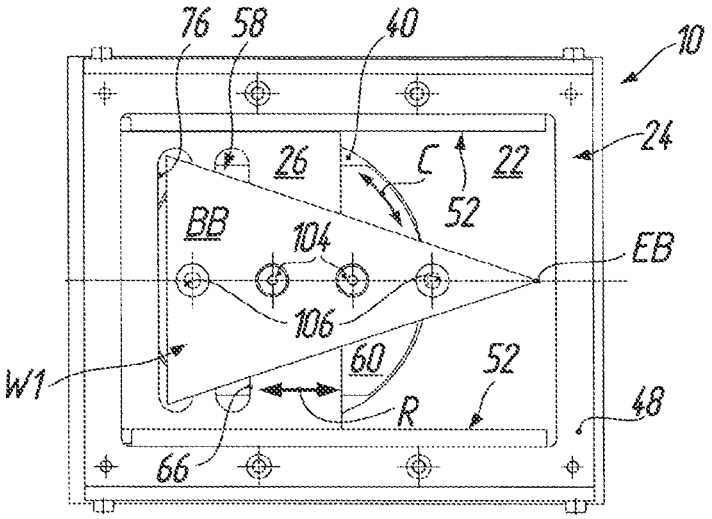
FIG. 7 shows an underneath view of the device, which is shown in FIG. 5, for fine-processing of an axicon, from below in FIG. 6.
Figure 8:
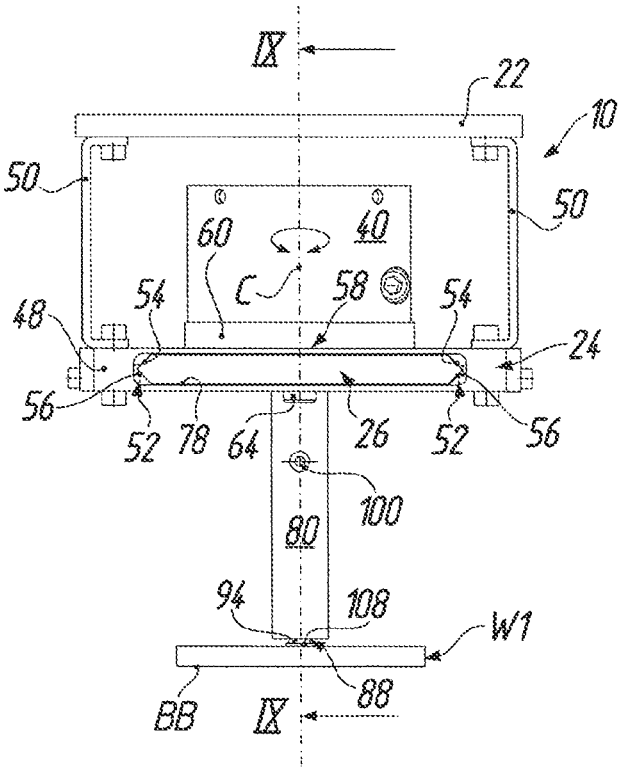
FIG. 8 shows a back view of the device, which is shown in FIG. 5, for fine-processing of an axicon, from the left in FIG. 6.

In FIGS. 1 and 2 there is denoted generally by the reference numeral 12—as a possible case of use or place of action of a device 10, which is explained in more detail further below particularly with reference to FIGS. 3 to 15, for fine-processing of an axicon L, which according to FIGS. 20 to 23 has at least one concave (or alternatively convex) cone surface KF with a cone axis KA and a cone angle $\alpha$—a CNC-controlled fine-processing machine, i.e. a machine for processing the surfaces and edges of optical workpieces by grinding, precision-grinding and/or polishing. The basic construction of this fine-processing machine 12 is explained in detail in U.S. Pat. No. 6,394,892 B2 of the present applicant, for which reason the fine-processing machine 12 shall be described in the following only to the extent appearing necessary for an understanding of the present invention. For the rest and for avoidance of repetition—with respect to the construction and function of a fine-processing machine 12—U.S. Pat. No. 6,394,892 B2 is hereby incorporated by reference.

The fine-processing machine 12 comprises in general a tool spindle 14 with a tool axis C of rotation, which is controlled in rotational speed, and a workpiece spindle with a workpiece axis D of rotation, which is regulated in rotational angle. The tool spindle 14 and the workpiece spindle 16 project into a work space 18 bounded by a machine bed 20 formed from polymer concrete. In that case, the tool spindle 14 and the workpiece spindle 16—as will be similarly described in more detail in the following—(inter alia) are movable (linear axis Y, linear axis Z) relative to one another, under positional regulation, in a notional plane Y-Z spanned by the tool axis C of rotation and the workpiece axis D of rotation, as well as pivotable, under regulation in rotational angle, relative to one another with respect to a pivot axis (A axis) extending perpendicularly to the plane Y-Z. The device 10 for fine-processing of axicons L is mounted on an end of the tool spindle 14, which faces the workpiece spindle 16.

For this purpose the device 10 comprises in general a base 22 or base plate, which is adapted to be flange-mounted on the tool spindle 14 of the fine-processing machine 12. Mounted on the base 22 is a guide arrangement 24 which guides in longitudinal movement a tool carriage 26 drivable to oscillate along an oscillation axis R. The tool carriage 26 itself carries a tool W1 or W2 for fine-processing of axicons L.

FIGS. 1 to 15, 20 and 21 show the tool W1 in accordance with a first variant, in which the tool W1 as seen in plan view has substantially the form of an isosceles triangle. This tool W1 has a processing region BB, which has a front end EB at a tip of the triangle and permits, on each of mutually opposite longitudinal sides of the triangle, linear engagement LE (cf. FIG. 20) with the cone surface KF to be processed of the axicon L.

By contrast, FIGS. 16 to 19, 22 and 23 show the tool W2 in accordance with a second variant in which the tool W2 is substantially strip-shaped. This tool W2 has a processing region BB, which has a front end EB at a transverse side of the tool W2 and permits, along a longitudinal side of the tool W2, linear engagement LE (see FIG. 23) with the cone surface KF to be processed of the axicon L.

Apart from the possibility of linear engagement LE of the respective processing region BB with the cone surface KF of the axicon L to be processed, it is common to the tools W1 and W2 that the respective processing region BB is provided with a commercially available polishing medium carrier (not shown in the figures). The polishing medium carrier can be, for example, a so-called "polishing foil" or, however, also a suitable foam with or without carrier material, which is glued onto the processing region BB of the tool W1, W2 with a certain degree of lateral protrusion and with the assistance of a commercially available adhesive. Polishing foils usable here are, for example, of polyurethane (PUR) in a thickness of 0.5 to 1.3 millimeters obtainable from the company James H. Rhodes & Company, Vernon, United States, whilst suitable foams can be acquired from, for example the company Getzner Werkstoffe GmbH, Oberhaching, Germany. A commercially available adhesive of the brand Pattex (Registered Trade Mark) of the company Henkel AG & Co. KGaA, Dusseldorf, Germany, for example, is suitable for gluing these polishing medium carriers onto the processing region BB of the respective tool W1, W2.

Returning to FIGS. 1 and 2 after this general overview of the fine-processing machine 12, the device 10 mounted thereon for the fine-processing of axicons L and the tool W1, W2 moved therewith, it can additionally be observed with respect to the fine-processing machine 12 that the machine bed 20 thereof has two parallel side walls 28 between which the work space 18 is formed. The side walls 28 mount a portal 30 which is movable under positional regulation along the linear axis Y in the longitudinal direction y of the fine-processing machine 12. A horizontal carriage 32 is guided to be longitudinally displaceable at the portal 30 in the width direction x of the fine-processing machine 12 and can be moved under positional regulation along the linear axis X. A vertical carriage 34 is in turn guided to be longitudinally displaceable at the horizontal carriage 32 in the height direction z of the fine-processing machine 12, the vertical carriage being movable under positional regulation along the linear axis Z and carrying the tool spindle 14.

As far as the workpiece side is concerned, a yoke 36 carrying the workpiece spindle 16 is provided in the work space 18. The yoke 36 is mounted on the side walls 28 of the machine bed 20 to be rotatable about the pivot axis A and can, under regulation, be driven or held in rotational angle by means of a torque motor and associated brake (not visible in the figures). Counterweights 38 provided at both sides in that case ensure weight compensation for the yoke 36.

The tool spindle 14 and the workpiece spindle 16 are provided, finally, at each of the mutually facing ends thereof with a respective clamping chuck 40 or 42, which can be constructed to be of, for example, hydro-expansion configuration. A cylindrical shank of a tool (not shown) can be held in a manner known per se by the clamping chuck 40 of the tool spindle 14. The clamping chuck 42 of the workpiece spindle 16 is constructed for the purpose of gripping and holding an optical workpiece, in the present application an axicon L, at a cylindrical edge surface RF of the axicon L (cf. FIGS. 20 to 23).

With regard to the kinematics of the fine-processing machine 12 it is evident in that respect to the expert that at the tool side the end, which projects into the work space 18, of the tool spindle 14 can be spatially moved and positioned in the work space 18 by use of the three linear axes X, Y and Z. In addition, the clamping chuck 40 can be driven by the tool spindle 14 to rotate about the tool axis C of rotation. At the workpiece side the end, which projects into the work space 18, of the workpiece spindle 16 can be adjusted or pivoted, defined in angle, with respect to the tool spindle 14 about the pivot axis A. Moreover, the clamping chuck 42 can be driven by the workpiece spindle 16 to rotate about the workpiece axis D of rotation and located in angular position.

Further details of the device 10 for fine-processing of axicons L can be inferred from FIGS. 3 to 9. As at the outset can be best recognized in FIGS. 4, 5 and 9, the base 22 has a circularly round hole 44 through which, in the state of the device 10 being mounted on the tool spindle 14, the workspace end of the tool spindle 14 with the clamping chuck 40 projects. In that case, the upper side of the base 22 forms a flat flange surface which can be placed from below against a spindle housing of the tool spindle 14. Provided for securing the base 22 to the tool spindle 14 in the illustrated embodiment are two securing screws 46 (see FIG. 4) which in the mounted state of the device 10 pass through associated fastening holes in the base 22 and are screwed into associated threaded bores (not shown) in the spindle housing of the tool spindle 14.

The guide arrangement 24, which is mounted on the base 22, for the tool carriage 26 comprises a guide frame 48 which is rectangular as seen in plan view and which is secured to the base 22 by way of securing brackets 50, which are arranged at the corners of the guide frame 48, with the assistance of screws so that the guide frame 48 extends parallel to and at a spacing from the base 22. Guide rails 52 for the tool carriage 26 are mounted by use of screws on the guide frame 48 at mutually opposite sides. As can be best recognized in FIGS. 5 and 8, the guide rails 52, which are made from a slide-bearing material, have a respective substantially V-shaped groove 54 on each of mutually facing sides, while the tool carriage 26 has a respective wedge-shaped guide section 56 on each of mutually remote sides, the wedge-shaped guide sections 56 of the tool carriage 26 being slidably received in the V-shaped grooves 54 of the guide rails 52. It will be apparent that the tool carriage 26 can thus be reciprocatingly moved in the guide frame 48 (oscillation axis R).

Figure 9:
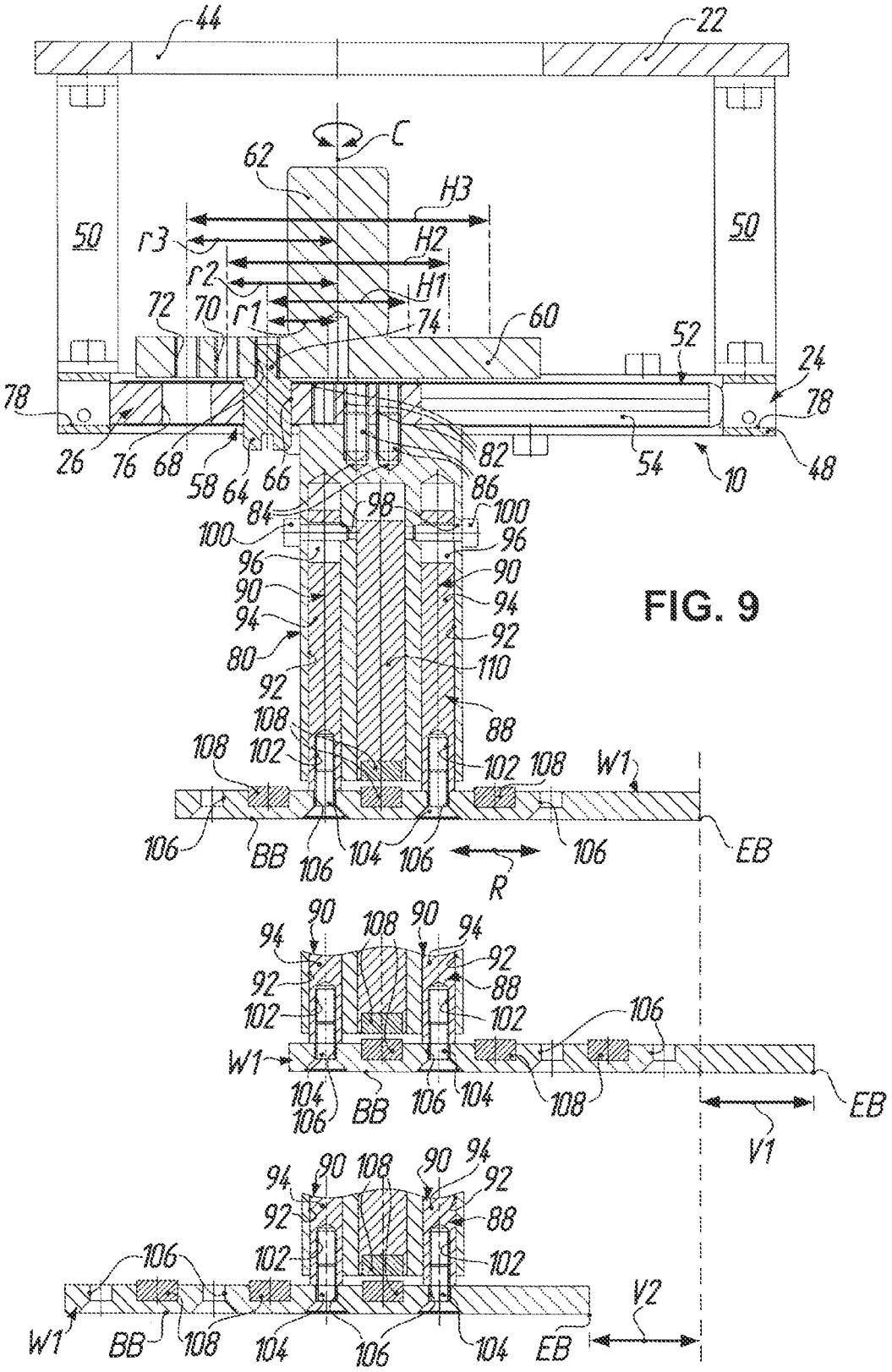
FIG. 9 shows a sectional view, which is to enlarged scale by comparison with FIG. 8, of the device, which is shown in FIG. 5, for fine-processing of an axicon—without the clamping chuck of the tool spindle—in correspondence with the section line IX-IX in FIG. 8, wherein the way in which the tool can be mounted on the device to be offset is illustrated in a lower part of FIG. 9.

Provided in the illustrated embodiment for the oscillating drive of the tool carriage 26 is a transmission mechanism 58 which is adapted to convert a rotational movement, which is produced by the tool spindle 14 of the fine-processing machine 12, into a reciprocating linear movement of the tool carriage 26 along the oscillation axis R. For this purpose the transmission mechanism 58 is configured in the manner of an eccentric drive and comprises a rotary disc 60 which is drivably connectable with the tool spindle 14 of the fine-processing machine 12 and is rotatable about an axis of rotation, here the tool axis C of rotation. As FIG. 9 shows, the rotary disc 60 has a cylindrical clamping projection 62 or clamping pin by way of which the rotary disc 60 can be clamped to the clamping chuck 40 of the tool spindle 14.

A guide pin 64 is mounted on the rotary disc 60 to be radially offset with respect to the axis C of rotation, the pin engaging in a slot 66 which is formed in the tool carriage 26 and which extends transversely to the movement direction of the tool carriage 26, thus to the oscillation axis R. As evident from FIGS. 9 to 13, a center axis of the guide pin 64 thus has a radial spacing r1 from the axis C of rotation of the rotary disc 60.

Figure 10:
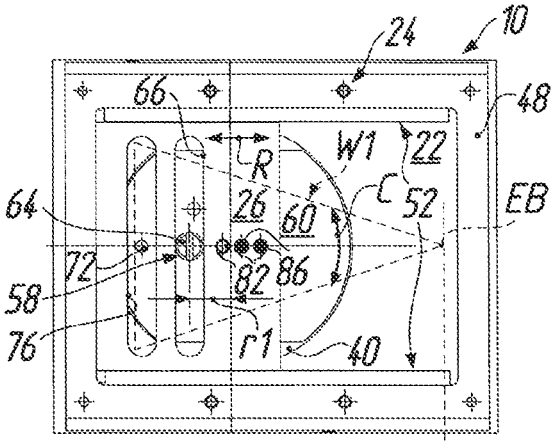
FIGS. 10 to 15 show schematic underneath views of the device, which is shown in FIG. 5, for fine-processing of an axicon, similar to the underneath view according to FIG. 7 and illustrating some of the possibilities of how the axial position and the stroke of the tool, which is indicated in dashed lines, in oscillation direction can be influenced.
Figure 11:
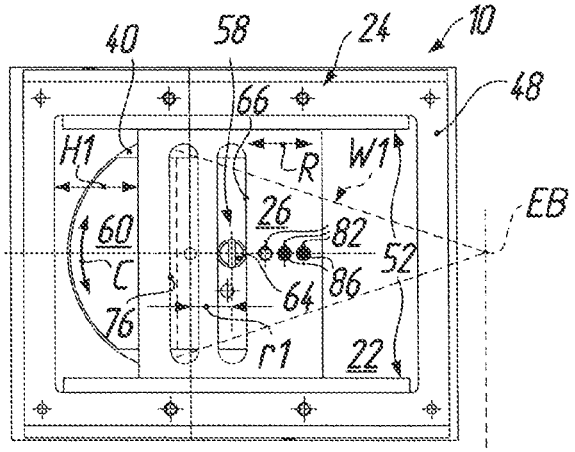

FIGS. 10 and 11 also illustrate what takes place in this embodiment of the transmission mechanism 58 when the rotary disc 60 rotates through 180° about the axis C of rotation from its rotational angle setting according to FIG. 10, so that it reaches the rotational angle setting according to FIG. 11 and, in particular, the tool carriage 26—which is constrainedly guided between the guide rails 52 of the guide arrangement 24—is thereby moved due to the interlocking engagement of the guide pin 64 with the slot 66 of the tool carriage 26 from the lefthand axial position, which is illustrated in FIG. 10, of the tool carriage 26 in the guide frame 48 to the right through a stroke H1 into the righthand axial position, which is illustrated in FIG. 11, of the tool carriage 26 in the guide frame 48. In that case, the stroke H1 of the tool carriage 26 is twice as large as the radial spacing r1 between the guide pin 64 and the axis C of rotation of the rotary disc 60.

If the rotary disc 60 is then further rotated out of its rotational angle setting according to FIG. 11 through 180° about the axis C of rotation so that it again reaches its rotational angle setting according to FIG. 10, the tool carriage 26 moves, by virtue of the mechanically positive engagement of the guide pin 64 with the slot 66, from the righthand axial position, which is illustrated in FIG. 11, of the tool carriage 26 in the guide frame 48 to the left through the stroke H1 back into the lefthand axial position, which is illustrated in FIG. 10, of the tool carriage 26 in the guide frame 48. It will be apparent that in this way a rotation of the rotary disc 60 about the axis C of rotation in the guide frame 48 constrains an oscillatory reciprocating movement of the tool carriage 26 with a predetermined stroke H1 along the oscillation axis R.

As can be best seen in FIG. 9, the rotary disc 60 in the illustrated embodiment is provided with a plurality of securing bores 68, 70, 72 for the guide pin 64. Each of these securing bores 68, 70, 72 is here formed as a threaded bore into which the guide pin 64 can be screwed by a threaded projection 74. The center axes of the securing bores 68, 70, 72 have a different radial spacing r1, r2, and r3, respectively, from the axis C of rotation so that a stroke H1, H2 or H3 of the tool carriage 26, which is settable in stages, in the guide frame 48 arises through displacement of the guide pin 64.

In the illustrated embodiment the tool carriage 26 is additionally provided with a further slot 76, which extends parallel to the slot 66. The guide pin 64 can be selectably brought into engagement with one or other slot 66, 76, whereby an axial relative position of the tool carriage 26 with respect to the axis C of rotation of the rotary disc 60 is settable in two stages.

Figure 12:
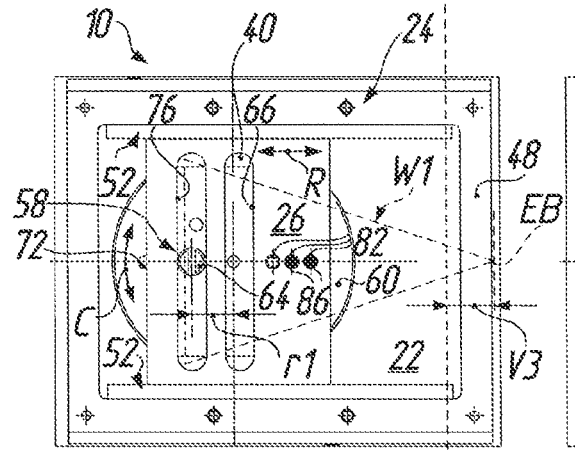
Figure 13:
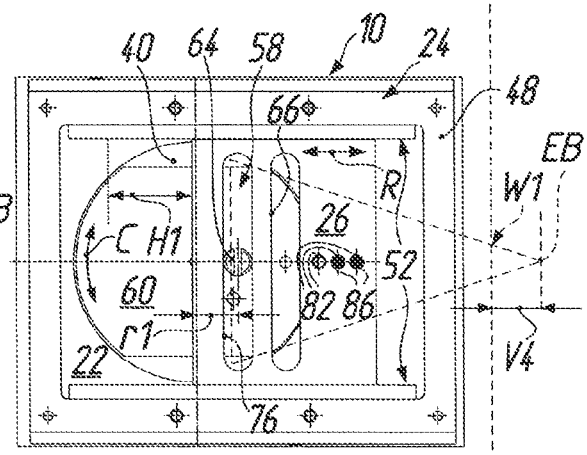

FIGS. 12 and 13 illustrate this by comparison with FIGS. 10 and 11 for the case that the guide pin 64 is not displaced at the rotary disc 60, i.e. is again secured by its threaded projection 74 in the securing bore 68, but on the other hand is brought by its free end into engagement with the other slot 76 in the tool carriage 26. In this case as well, rotation of the rotary disc 60 about the axis C of rotation produces an oscillatory reciprocating movement of the tool carriage 26 with the stroke H1 in the guide frame 48 (see FIG. 13), but this with axial end positions of the tool carriage 26 different from the axial end positions with the slot engagement in accordance with FIGS. 10 and 11. Resulting therefrom for the two axial end positions of the tool carriage 26—compared with the basic configuration according to FIGS. 10 and 11—is a respective offset V3 or V4 of the front end EB of the tool W1, which is drivably connected with the tool carriage 26, indicated in FIGS. 10 to 15 by dashed lines.

Figure 14:
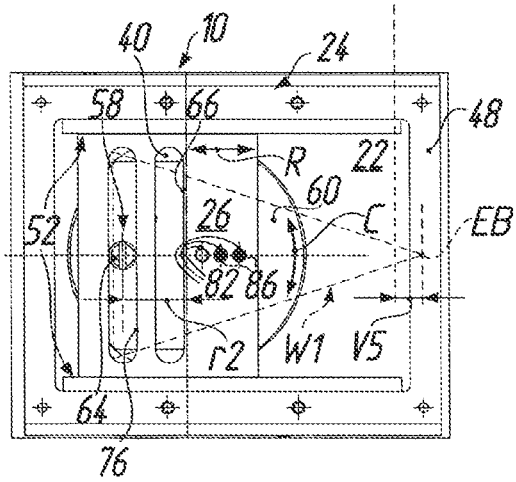
Figure 15:
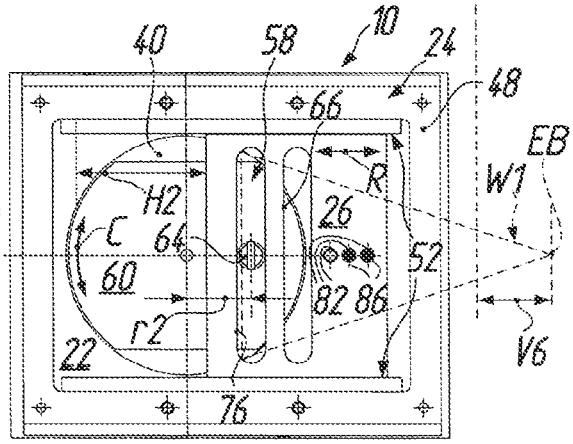
Figure 16:
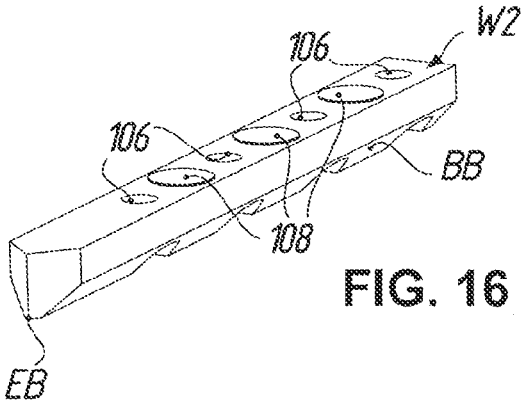
FIG. 16 shows a perspective view of another, substantially strip-shaped tool for the device, which is shown in FIG. 5, for fine-processing of an axicon, obliquely from above and the front right.
Figure 17:
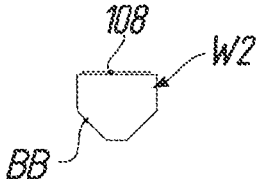
FIG. 17 shows a back view of the tool according to FIG. 16, from behind in FIG. 16.
Figure 18:
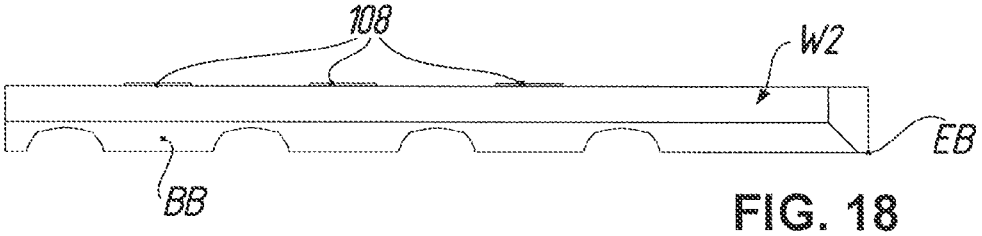
FIG. 18 shows a side view of the tool according to FIG. 16, from the right in FIG. 17.
Figure 19:
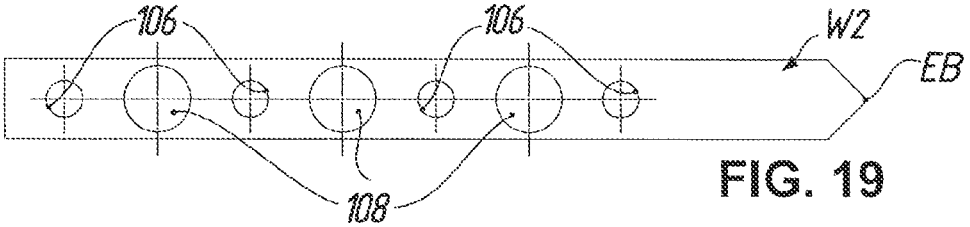
FIG. 19 shows a plan view of the tool according to FIG. 16, from above in FIG. 17.

Illustrated in FIGS. 14 and 15 is a combination of the afore-described adjustment measures, namely change of the stroke H1, H2, H3 of the tool carriage 26 by displacing the guide pin 64 in the securing bores 68, 70, 72 of the rotary disc 60, and changing the axial start and reversal positions of the tool carriage 26 in the guide frame 48 by selection of a different slot 66, 76 of the tool carriage 26 for the engagement with the guide pin 64. In this case, by comparison with FIGS. 10 and 11 the guide pin 64 is in engagement with the other slot 76 of the tool carriage 26, but compared with FIGS. 12 and 13 it is at the same time also screwed into a different securing bore 70 in the rotary disc 60. Thus, by comparison with the settings according to FIGS. 10 to 13 the result is a larger stroke H2 and different axial start and reversal positions of the tool carriage 26, as is apparent from a "vertical" comparison of FIGS. 10, 12 and 14 and FIGS. 11, 13 and 15, which show guide frames 48 aligned for that purpose. The result here is an offset V5 or V6 at the front end EB of the tool W1 for the two axial end positions of the tool carriage 26.

It may also be mentioned at this point that the guide frame 48 is provided at its short side with slot-like openings 78 which are so dimensioned that the tool carriage 26, depending on its stroke H1, H2, H3 and/or its axial relative position with respect to the axis C of rotation of the rotary disc 60, in the case of its reciprocating movement in the guide frame 48 is optionally capable of entering one of the openings 78, which is not, however, shown in the figures.

As can be further inferred particularly from FIG. 9, a block-shaped connecting part 80 for the tool W1 or W2 at the tool carriage 26 is secured on the side, which is remote from the rotary disc 60, of the tool carriage 26. For that purpose, three securing bores 82 with an internal thread are formed in the tool carriage 26 in the illustrated embodiment, the bores lying one after the other with the same spacing from one another as seen along the oscillation axis R, whilst the connecting part 80 has two associated blind bores 84 with an internal thread. Grub screws 86 are screwed into two adjacent securing bores 82 of the tool carriage 26 and extend into the blind bores 84 of the connecting part 80 so as to fix the connecting part 80 to the tool carriage 26.

Since three—or optionally even more—securing bores 82 are provided in the tool carriage 26 the connecting part 80 can be variably secured, in its axial position along the oscillation axis R, to the tool carriage 26. This in turn has an influence on which axial relative position the tool W1 or W2 adopts, as seen along the oscillation axis R, with respect to the axis C of rotation of the rotary disc 60. In FIGS. 10 to 15 the grub screws 86 are indicated by solid circles; the axial position of the connecting part 80 with respect to the tool carriage 26 here corresponds with the grouping shown in FIG. 9.

It can also be recognized in FIG. 9 that the connecting part 80 is provided with a further guide arrangement 88 which serves the purpose of guiding the tool W1, W2 to be movable in a direction transverse to the oscillation axis R of the tool carriage 26. In the illustrated embodiment the further guide arrangement 88 comprises two guide cylinders 90 which respectively extend perpendicularly to the oscillation axis R and parallel to one another. In that regard, each guide cylinder 90 comprises a cylinder bore 92, which is formed as a blind bore, in the connecting part 80 and a cylinder pin 94 received in the manner of a piston in the respective cylinder bore 92 to be axially displaceable.

Each cylinder pin 94 is provided at its end facing the tool carriage 26 with an oblong hole 96. In addition, threaded bores 98, which extend transversely to the cylinder bores 92 and into each of which a respective cap screw 100 penetrating the oblong hole 96 in the associated cylinder pin 94 is screwed, are formed in the connecting part 80 in the proximity of the closed ends of the cylinder bores 92. It will be apparent that the combination of oblong hole 96 and cap screw 100 allows a limited axial displacement of the respective cylinder pin 94 in the associated cylinder bore 92, yet the cap screws 100 prevent the cylinder pins 94 from being able to be withdrawn from the cylinder bores 92.

Each cylinder pin 94 has at its end remote from the tool carriage 26 a blind bore 102—which is formed at the end face—with an internal thread into which a securing screw 104, here executed as a countersunk-head screw, for the tool W1 or W2 is screwed. Each tool W1 or W2 has several, in the illustrated embodiments in each instance four, screw holes 106 which in longitudinal direction of the respective tool W1 or W2 are arranged on a line at the same spacing from one another. The tool W1, W2 can thus be mounted on the further guide arrangement 88, more precisely the cylinder pins 94 thereof, to be variable in its axial position along the oscillation axis R, wherein the securing screws 104 respectively penetrate adjacent screw holes 106 in the respective tool W1 or W2.

This further axial adjustment possibility for the tool W1 or W2 is illustrated in FIG. 9 by way of example for the triangular tool W1. Starting from a basic configuration in which the tool W1 is mounted on the guide arrangement 88 in a central position by the securing screws 104, which extend through the central screw holes 106 of the tool W1, the tool W1 can thus be secured to the guide arrangement 88 further forwardly (as shown centrally in FIG. 9) or further rearwardly (illustrated below in FIG. 9) for a specific axial position of the tool carriage 26 in the guide frame 88 as seen along the oscillation axis R. An offset V1 or V2 at the front end EB of the tool W1, by comparison with the basic configuration according to the upper part of FIG. 9, results therefrom.

Finally, the respective tool W1, W2 is additionally loaded in the direction transverse or perpendicular to the oscillation axis R of the tool carriage 26 by a force which urges the tool W1 or W2 away from the connecting part 80. In the illustrated embodiment this force is applied by mutually repelling magnets 108 arranged between the connecting part 80 and the tool W1 or W2. During the actual polishing process these magnets 108 ensure that polishing pressure at the processing region BB of the respective tool W1, W2 is not excessive.

More precisely, the magnets 108 are arranged, as can be recognized in FIGS. 6, 8, 9 and 16 to 19, at the respective tool W1 or W2 on the side thereof, which faces the tool carriage 26, between the screw holes 106 and in a line with the screw holes 106. A magnet 108 is arranged at the connecting part 80 on the end, which faces the respective tool W1 or W2, of the connecting part 80 between the cylinder bores 92 and on a line with the cylinder bores 92, here at an insert 110 in the connecting part 80. In every case the respective magnet 108 is received in an associated recess and suitably secured, for example by an adhesive.

It is apparent from the preceding description that with the assistance of the device 10 equipped with one of the tools W1, W2 and with use of geometrically indeterminate cutting edges in the form of bound or loose grain in combination with a liquid at the processing region BB of the tool W1 or W2 it is possible to perform a method for fine-processing of an axicon L in which by means of the tool W1 or W2 a material removal at the cone surface KF of the axicon L is produced by a relative cutting speed which arises solely from a) a rotational movement—here produced by the workpiece axis D of rotation of the workpiece spindle 16—of the axicon L about the cone axis KA, and b) a relative oscillating linear movement—here produced by way of the oscillation axis R of the device 10—of the tool W1 or W2 in that case disposed in linear engagement LE with the cone surface KF to be processed, in which the front end EB of the processing region BB as seen in a plan view moves back and forth in radial direction with respect to the cone axis KA.

Figure 20:
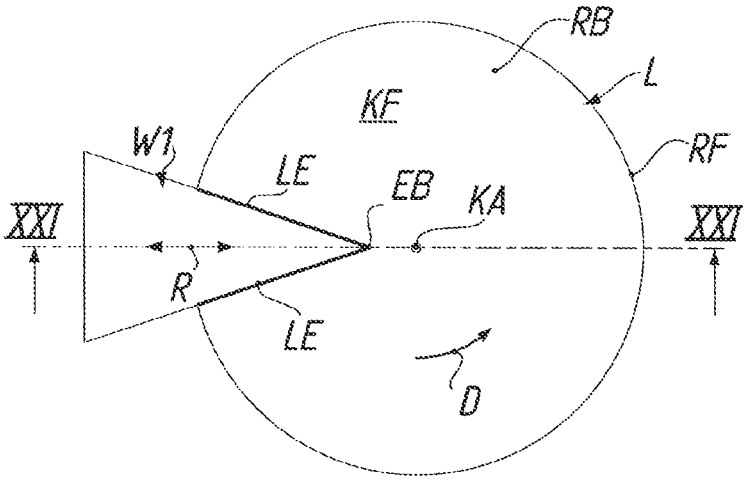
FIG. 20 shows a schematic plan view of a concave axicon which is processed in accordance with the invention by means use of the substantially triangular tool shown in FIG. 5.
Figure 21:
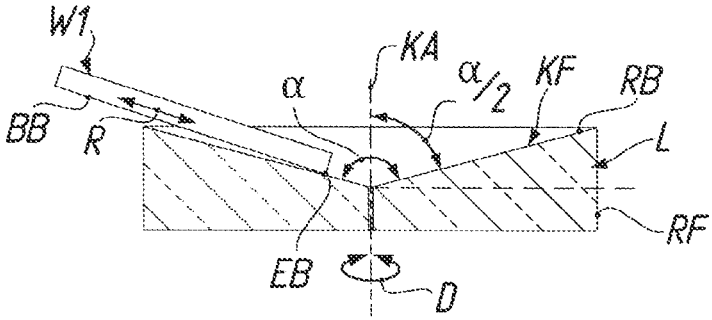
FIG. 21 shows a schematic sectional view of the concave axicon and triangular tool, which are shown in FIG. 20, in correspondence with the section line XXI-XXI in FIG. 20.
Figure 22:
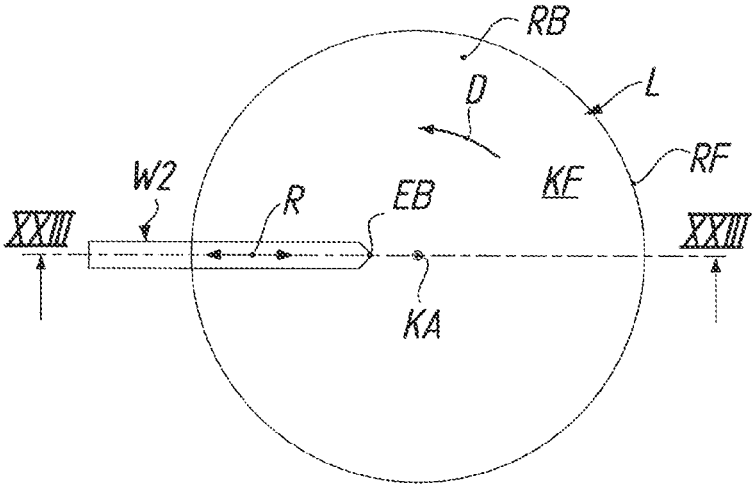
FIG. 22 shows a schematic plan view of a concave axicon, which is processed in accordance with the invention by means use of the substantially strip-shaped tool shown in FIGS. 16 to 19.
Figure 23:
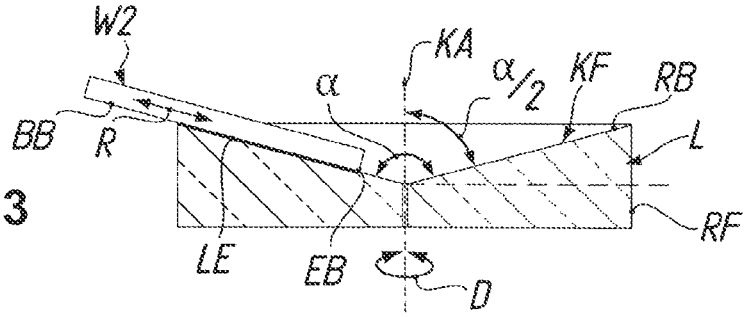
FIG. 23 shows a schematic sectional view of the concave axicon and strip-shaped tool, which are shown in FIG. 22, in correspondence with the section line XXIII-XXIII in FIG. 22.

This tool engagement with combined motions of tool and workpiece is illustrated in FIGS. 20 and 21 for the triangular tool W1 and in FIGS. 22 and 23 for the strip-shaped tool W2, in both cases at an axicon L with a concave cone surface KF. In that regard, through the use of thicker lines FIGS. 20 and 23 illustrate the linear engagement LE of the respective tool W1 (here double, on both sides of the tool W1) or W2 (here single, on the lower side of the tool W2) with the cone surface KF, which is to be subjected to fine-processing, of the axicon L. In the case of an axicon with a convex cone surface, the strip-shaped tool W2 would be used with its tool lower contact line, because the triangular tool W1 would not be capable of contacting a convex cone surface as shown in FIG. 20.

When carrying out the afore-described method for fine-processing of an axicon L initially a relative alignment and adjustment movement is produced between the axicon L and the tool W1 or W2 in accordance with the cone angle $\alpha$, as a consequence of which the processing region BB of the tool W1 or W2 enters into the linear engagement LE with the cone surface KF of the axicon L, in which case the front end EB of the processing region BB faces the cone axis KA. It will be apparent to the expert that the angular alignment movement with the afore-described fine-processing machine 12 takes place at the workpiece side with the pivot axis A at the yoke 36 carrying the workpiece spindle 16. Equally, it will be apparent that on the other hand the spatial adjustment movement with the afore-described fine-processing machine 12 takes place at the tool side by way of the three linear axes X, Y, Z associated with the tool spindle 14.

If the "biased" linear engagement LE, which is defined by the magnets 108 at the connecting part 80 and the respective tool W1 or W2, between the tool W1 or W2 and the cone surface KF, which is to be finely processed, of the axicon L is produced, then—by the tool spindle 14, the rotary disc 60 clamped thereto and the transmission mechanism 58 of the device 10 as described in the foregoing—there is generated between the axicon L, which is driven by way of the workpiece axis D of rotation of the workpiece spindle 16 to rotate about the cone axis KA, and the tool W1 or W2 the relative oscillatory linear movement (oscillation axis R) as an advance movement in which the front end EB of the processing region BB during a revolution of the axicon L about the cone axis KA as seen in plan view moves multiple times over the cone surface KF from an outer edge region RB of the cone surface KF—in a direction which is radial with respect to the cone axis KA—at least into the proximity of the cone axis KA and back again.

During the fine-processing of the cone surface KF, then—by way of the workpiece spindle 16—a rotational speed of the axicon L about the cone axis KA and—by use of appropriate rotational speed control of the tool spindle 14—a frequency of the relative oscillatory linear movement (oscillation axis R) of the tool W1 or W2 over the cone surface KF can be matched to one another in such a way that the number of reciprocating movements of the tool W1 or W2 per revolution of the axicon L is not even-numbered. A continuous "track change" of the oscillating tool W1 or W2 on the fine-processed cone surface KF of the rotating axicon L thus arises. In tests carried out by the inventors very good fine-processing results could be achieved with a ratio of frequency to rotational speed in which during the fine-processing of the cone surface KF the number of reciprocating movements of the tool W1 or W2 per revolution of the axicon L about the cone axis KA was greater than or equal to three and less than or equal to seven.

The fine-processing machine 12, which is shown in FIGS. 1 and 2 and known per se and on the tool spindle 14 of which the device 10 explained above in detail is mounted, can thus be used in the afore-described mode and manner for fine-processing of an axicon L having at least one concave or convex cone surface KF with a cone axis KA and a cone angle α.

In a method for fine-processing of an axicon having a concave or convex cone surface with a cone axis and a cone angle, with use of geometrically indeterminate cutting edges in the form of bound or loose grain in combination with a liquid at a processing region of a tool, which is constructed for linear engagement with the cone surface and has an end at the front with respect to the cone axis, there is produced at the cone surface a material removal by a relative cutting speed which arises solely from a rotational movement of the axicon about the cone axis and a relative oscillating linear movement (oscillation axis) of the tool, in which the processing region is in linear engagement with the cone surface and its front end as seen in plan view moves back and forth in a direction radial with respect to the cone axis. In addition, a device usable for this method and mountable on a tool spindle of a fine-processing machine is disclosed.

Other variations and modifications are possible without departing from the scope and spirit of the present invention as defined by the appended claims.

What is claimed is:

1. A device (10) for fine-processing of an axicon (L), which has at least one concave or convex cone surface (KF) with a cone axis (KA) and a cone angle (α), comprising:

a tool (W1, W2) having a processing region (BB) for linear engagement (LE) with the cone surface (KF) to be processed;

a base (22), which is adapted to be flange-mounted on a tool spindle (14) of a fine-processing machine (12) and on which is mounted a guide arrangement (24) configured to guide a tool carriage (26), wherein the tool carriage is configured to oscillate along an oscillation axis (R) and carry the tool (W1, W2) for fine-processing of the axicon (L), and wherein the tool carriage is longitudinally moveable;

wherein provided for an oscillatory drive of the tool carriage (26) is a transmission mechanism (58) adapted to convert a rotational movement produced by the tool spindle (14) of the fine-processing machine (12) into a reciprocating linear movement of the tool carriage (26) along the oscillation axis (R), and wherein the transmission mechanism (58) comprises a rotary disc (60), which is drivably connectable with the tool spindle (14) of the fine-processing machine (12) and is rotatable about an axis (C) of rotation and on which a guide pin (64) is mounted to be radially offset with respect to the axis (C) of rotation, the guide pin engaging in a slot (66, 76) which is formed to extend in the tool carriage (26) transversely to the oscillation axis (R) so that the tool carriage (26) is drivable to oscillate along the oscillation axis (R) with a predetermined stroke (H1, H2, H3).

2. The device (10) according to claim 1, wherein the rotary disc (60) is provided with a plurality of securing bores (68, 70, 72) for the guide pin (64), the bores having a different radial spacing (r1, r2, r3) from the axis (C) of rotation so that the predetermined stroke (H1, H2, H3) of the tool carriage (26) is settable.

3. The device (10) according to claim 1, wherein said slots (66, 76) are mutually parallel for selectable engagement of the guide pin (64), by way of which an axial relative position of the tool carriage (26) with respect to the axis (C) of rotation is settable.

4. A device (10) for fine-processing of an axicon (L), which has at least one concave or convex cone surface (KF) with a cone axis (KA) and a cone angle (α), comprising:

a tool (W1, W2) having a processing region (BB) for linear engagement (LE) with the cone surface (KF) to be processed;

a base (22), which is adapted to be flange-mounted on a tool spindle (14) of a fine-processing machine (12) and on which is mounted a guide arrangement (24) guiding a tool carriage (26), wherein the tool carriage is configured to oscillate along an oscillation axis (R) and carry the tool (W1, W2) for fine-processing of the axicon (L), and wherein the tool carriage is longitudinally moveable;

wherein provided for an oscillatory drive of the tool carriage (26) is a transmission mechanism (58) adapted to convert a rotational movement produced by the tool spindle (14) of the fine-processing machine (12) into a reciprocating linear movement of the tool carriage (26) along the oscillation axis (R), and wherein a connecting part (80) with a further guide arrangement (88) is mounted on the tool carriage (26) and serves for guiding the tool (W1, W2) to be movable in a direction transverse to the oscillation axis (R) of the tool carriage (26) and wherein the tool (W1, W2) is loaded in the direction transverse to the oscillation axis (R) of the tool carriage (26) by a force urging the tool (W1, W2) away from the connecting part (80).

5. The device (10) according to claim 4, wherein the force is supplied by at least two mutually repelling magnets (108) arranged between the connecting part (80) and the tool (W1, W2).

6. The device (10) according to claim 4, wherein the further guide arrangement (88) comprises at least one guide cylinder (90).

7. The device (10) according to claim 4, wherein the connecting part (80) is secured to the tool carriage (26) to be variable in its axial position along the oscillation axis (R).

8. The device (10) according to claim 4, wherein the tool (W1, W2) is mounted on the further guide arrangement (88) to be variable in its axial position along the oscillation axis (R).

9. A fine-processing machine (12), comprising:

a tool spindle (14) with a tool axis (C) of rotation, a workpiece spindle (16) with a workpiece axis (D) of rotation, wherein the tool spindle and the workpiece spindle project into a work space (18) bounded by a machine bed (20) and are movable relative to one another (Y axis, Z axis) at least in a plane (Y-Z) spanned by the tool axis (C) of rotation and the workpiece axis (D) of rotation, and the tool spindle and the workpiece spindle are pivotable relative to one another with respect to a pivot axis (A axis) extending perpendicularly to the plane (Y-Z), a device (10) for fine-processing of an axicon (L) which has at least one concave or convex cone surface (KF) with a cone axis (KA) and a cone angle ($\alpha$), comprising a tool (W1, W2) having a processing region (BB) for linear engagement (LE) with the cone surface (KF) to be processed, wherein the device (10) has a base (22), which is adapted to be flange-mounted on the tool spindle (14) of the fine-processing machine (12), and on which is mounted a guide arrangement (24) configured to guide a tool carriage (26), wherein the tool carriage is configured to oscillate along an oscillation axis (R) and carry the tool (W1, W2) for fine-processing of the axicon (L), wherein the tool carriage is longitudinally movable, and wherein the device (10) is mounted on an end of the tool spindle (14) facing the workpiece spindle (16).

10. The fine-processing machine (12) according to claim 9, wherein the machine bed (20) has two side walls (28) between which the work space (18) is formed and which mount a portal (30), which is movable in a longitudinal direction (Y axis) and at which the tool spindle (14) is guided to be movable at least in a direction (Z axis) perpendicular to the longitudinal direction (Y axis), and wherein a yoke (36) is provided in the work space (18), which carries the workpiece spindle (16) and is mounted on the side walls (28) to be rotatable about the pivot axis (A).

* * * * *